US007290349B1

(12) United States Patent
Carpenter

(10) Patent No.: US 7,290,349 B1
(45) Date of Patent: Nov. 6, 2007

(54) BLADE SETTING TOOL

(76) Inventor: Bobby J. Carpenter, 670 Timber Creek Dr., Hernando, MS (US) 38632

( * ) Notice: Subject to any disclaimer, the term of this patent is extended or adjusted under 35 U.S.C. 154(b) by 218 days.

(21) Appl. No.: 11/226,720

(22) Filed: Sep. 14, 2005

(51) Int. Cl.
*B26B 19/20* (2006.01)

(52) U.S. Cl. ..... 33/628; 33/344; 30/200

(58) Field of Classification Search ..... 33/628, 33/644–645, 613; 30/200
See application file for complete search history.

(56) References Cited

U.S. PATENT DOCUMENTS 1,628,421 A * 5/1927 Patenauade ..... 30/200
1,807,811 A 6/1931 Osdel
3,344,520 A * 10/1967 Williams ..... 30/200
4,724,614 A 2/1988 Wahl et al.
7,188,422 B2 * 3/2007 McCambridge et al. ..... 30/123

* cited by examiner

*Primary Examiner*—Yaritza Guadalupe-McCall

(57) ABSTRACT

A blade setting tool for calibrating the mounting position of a reciprocating blade in an electric trimmer after the blade has been removed for cleaning or sharpening. The blade setting tool provides a time-saving and convenient method for mounting of the reciprocating blade such that a predetermined clearance is maintained between the reciprocating blade and the stationary blade to avoid cutting or biting problems during a hair cut.

10 Claims, 2 Drawing Sheets

BLADE SETTING TOOL

The present invention generally relates to a calibration tool for setting a reciprocating blade on an electric trimmer and more particularly, relates to a calibration tool for setting the reciprocating blade on an electric trimmer to a predetermined clearance such that the blade does not cut or bite the skin of a customer when used by a barber or a hair stylist.

BACKGROUND OF THE INVENTION

Electric hair trimmers have been widely used in trimming hair by barbers and hair stylists. The hair trimmer is normally constructed of a stationary blade that has a substantially straight role of cutting teeth, and a reciprocating blade that has a roll of cutting teeth that is complimentary to the roll of teeth on the stationary blade. When hair enters into a space between the adjacent teeth of the stationary blade, a tooth on the reciprocating blade passes across the space and thereby engaging and shearing the hair. The electric hair trimmers are capable of trimming hair to a very small distance from the skin or scalp of a person.

An electric hair trimmer, after repeated use, must be cleaned, sharpened and recalibrated such that the trimmer can cut hair effectively, without cutting or biting the skin of the person. When the reciprocating blade is removed from the trimmer for cleaning or sharpening, it is usually reassembled into the trimmer on a trial and error basis. There are no tools currently available in calibrating the position of the reciprocating blade relative to the stationary blade in the trimmer. It is therefore a time consuming and laborious process for remounting a reciprocating blade into a trimmer.

It is therefore an object of the present invention to provide a blade setting tool for mounting a reciprocating blade into an electric hair trimmer.

It is another object of the present to provide a blade setting tool that can be used to effectively calibrate the position of the reciprocating blade relative to the stationary blade.

It is still another object of the present invention to provide a blade setting tool that enables the mounting of a reciprocating blade into an electric trimmer with minimum calibration effort.

It is still another further object of the present invention to provide a blade setting tool that is capable of calibrating a reciprocating blade when it is mounted into an electric hair trimmer such that the trimmer does not cut or bite the skin of a person.

SUMMARY OF THE INVENTION

In accordance with the present invention, a blade setting tool for calibrating the position of a reciprocating blade relative to a stationary blade in an electric hair trimmer is provided. The blade setting tool can be advantageously used in the remounting of the reciprocating blade after the blade has been cleaned or sharpened.

In a preferred embodiment, a blade setting tool is constructed by an elongated base plate that has two opposing end walls formed integrally with and projecting upwardly from a top surface of the elongated base plate; a calibration blade that has a first plurality of teeth fixedly mounted to an inside surface of a first end wall, the first plurality of teeth is parallel to the top surface of the elongated base plate; a compression plate slideably mounted juxtaposed to an inside surface of a second end wall facing the first end wall; a compression means for compressing the compression plate towards the first end wall when a reciprocating blade/stationary blade assembly is mounted in between the compression plate and the first end wall; and at least two apertures in the elongated base plate for mounting by screws the reciprocating blade to a trimmer after a second plurality of teeth on the reciprocating blade intimately engages and mashes the first plurality of teeth on the calibration plate.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses a blade setting tool for use in calibrating the position of a reciprocating blade used in an electric trimmer after the blade has been removed for cleaning or sharpening. The blade-setting tool can be used efficiently to calibrate the position and mounting of the reciprocating blade relative to the stationary blade such that when the trimmer is used, no cutting or biting of the skin of the person receiving a hair cut can occur.

The present invention blade setting tool is a device that enables the setting of hair trimmer blades to the appropriate position to avoid cuts and biting of the skin of a customer. The device can be advantageously used in professional barber shops and beauty salons. The blade setting tool enables one to position blades in such a manner as to allow a more accurate method of trimming a customer's hair. The blade setting tool includes a bottom plate that would slide underneath the teeth of the calibration blade, which is mounted at one end of the tool. Screws are then used to secure the position of the reciprocating blade in the hair trimmer. The reciprocating blade, sometimes called the liner blade, must be accurately mounted in the electric trimmer in order for the trimmer to work satisfactorily without the cutting or biting problems. The present invention blade setting tool enables one to efficiently set the reciprocating blade with a clearance between about 0.024 and about 0.025 inches from the tip of the stationary blade and thus avoiding problems in the function of the trimmer.

Figure 1:
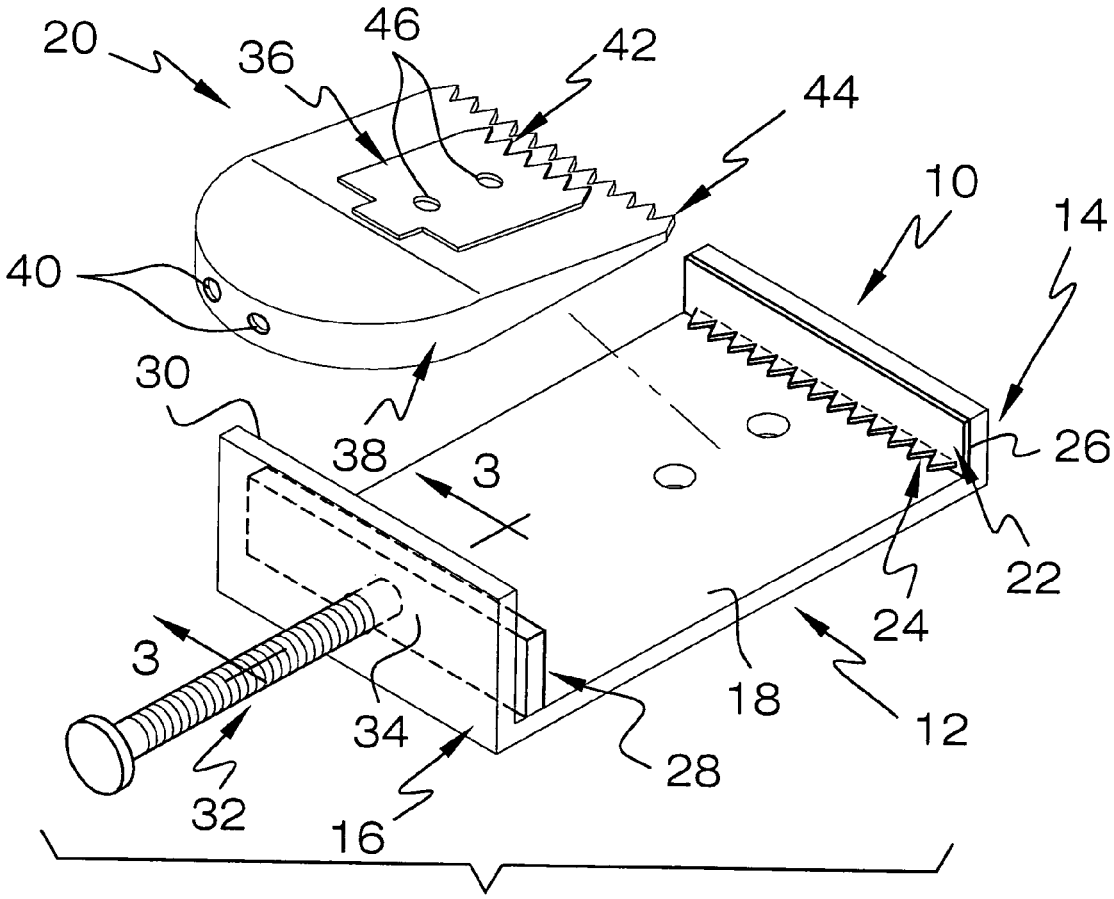
FIG. 1 is a perspective view of the blade setting tool and a reciprocating blade/stationary blade assembly to be calibrated.

Referring initially to FIG. 1, wherein a present invention blade setting tool 10 is shown in a perspective view. A reciprocating blade/stationary blade assembly 20 is also shown in FIG. 1 for mounting into the setting tool 10.

The blade setting tool 10 is constructed by a base plate 12 that has two opposing end walls 14, 16 projecting upwardly from a top surface 18 of the elongated base plate 12.

The two opposing end walls 14, 16 may be formed integrally with the elongated base plate 12, or may be assembled to the elongated base plate 12 by mechanical means, such as by screws (not shown). On the first end wall 14 is mounted a calibration blade 22 that has a first plurality of teeth 24 fixedly mounted to the inside surface 26 of the first end wall 14. The first plurality of teeth 24 is mounted parallel to the top surface 18 of the elongated base plate 12 as shown in FIG. 1.

The present invention blade setting tool 10 further includes a compression plate 28 which is slidably mounted juxtapose to end spaced apart from the inside surface 30 of the second end wall 16 facing the first end wall 14. The compression plate 28 is compressed toward the first end wall 14 by a compression means 32, such as a threaded bolt, as shown in FIG. 1. The threaded bolt 32 engages a threaded hole 34 in the second end wall 16 and thus pushing on the compression plate 28 and the reciprocating blade/stationary blade assembly 20 when it is mounted on the elongated base plate 12. It should be noted that the reciprocating blade/stationary blade assembly 20 has a reciprocating blade 36 and a stationary blade 38. Two mounting aperatures 40 which are threaded are further provided in the end of the stationary blade 38 for mounting into an electric trimmer (not shown).

Figure 2:
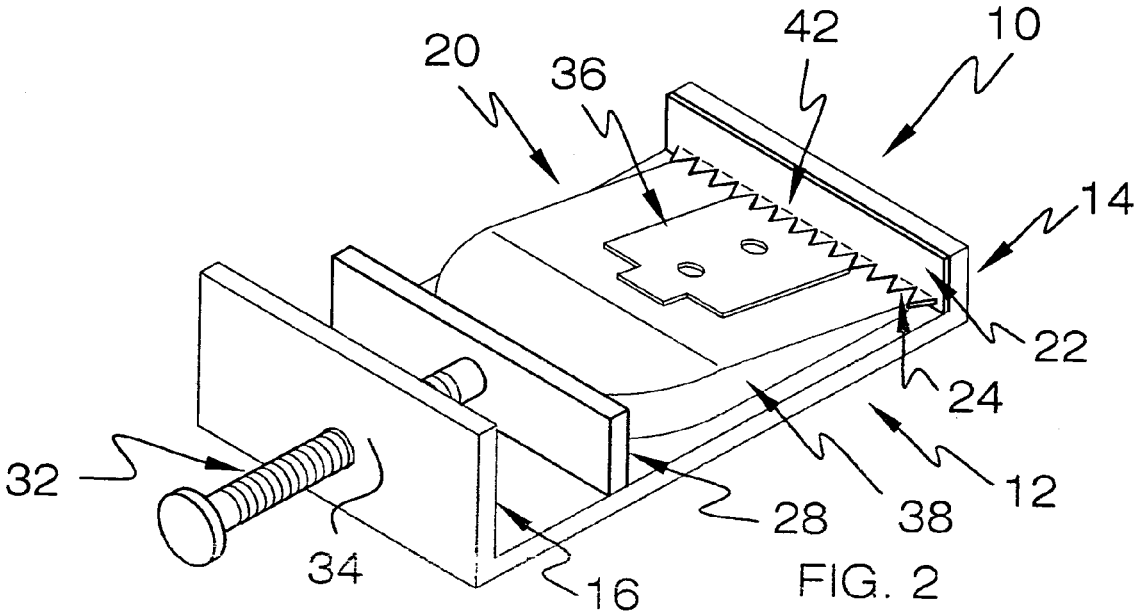
FIG. 2 is a perspective view of the present invention blade setting tool with the reciprocating blade/stationary blade assembly mounted therein.
Figure 4:
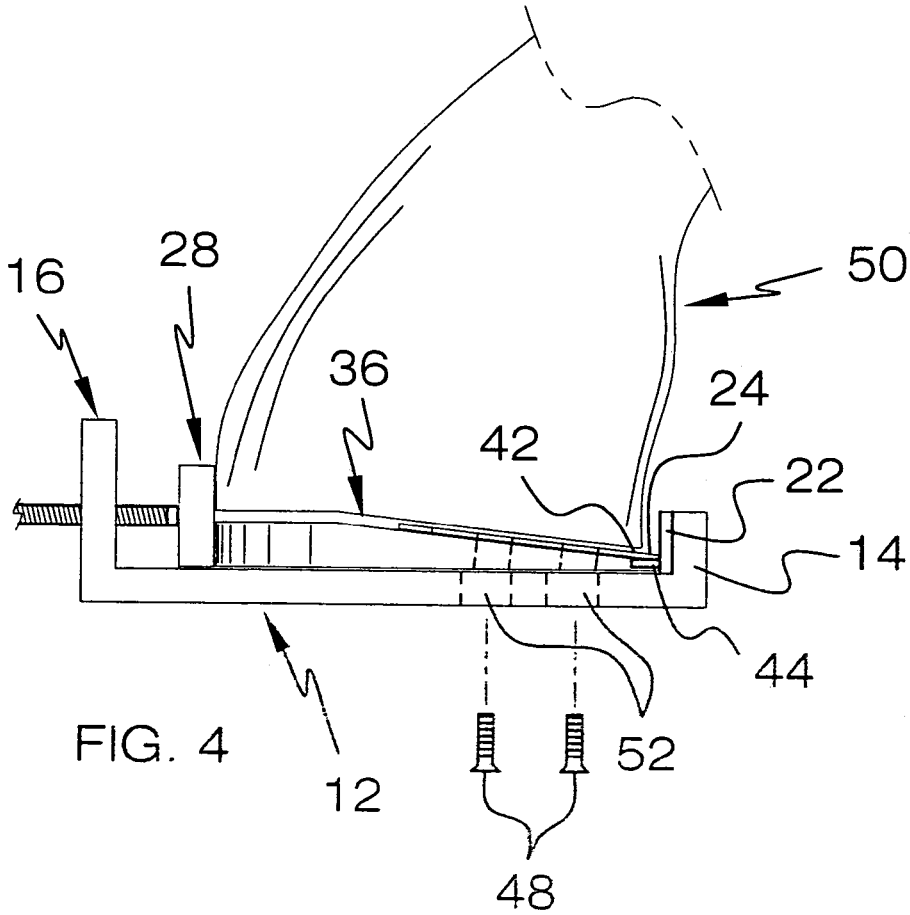
FIG. 4 is a cross sectional view of the present invention blade setting tool with a trimmer shown in ghost lines.

FIG. 2 is a perspective view of the present invention blade setting tool 10 with the reciprocating blade/stationary blade 20 mounted therein. It should be noted that the first plurality of teeth 24 on the calibration blade 22 intimately engages and mashes with the second plurality of teeth 42 on the reciprocating blade 36, while the third plurality of teeth 44 on the stationary blade 38 is inserted under the first plurality of teeth 24 of the calibration blade 22, as shown in FIG. 2. The position of the reciprocating blade 36 is thus fixed by the intimate engagement and then, two screws are used to mount the reciprocating blade to a reciprocating linkage (not shown) in the electric trimmer 50. This is shown in FIG. 4. The mounting of the reciprocating blade 36 is achieved through two mounting holes 46 provided in the reciprocating blade 36. This is made possible by inserting two mounting screws 48 through two apertures 52 in the elongated base plate 12.

Figure 3:
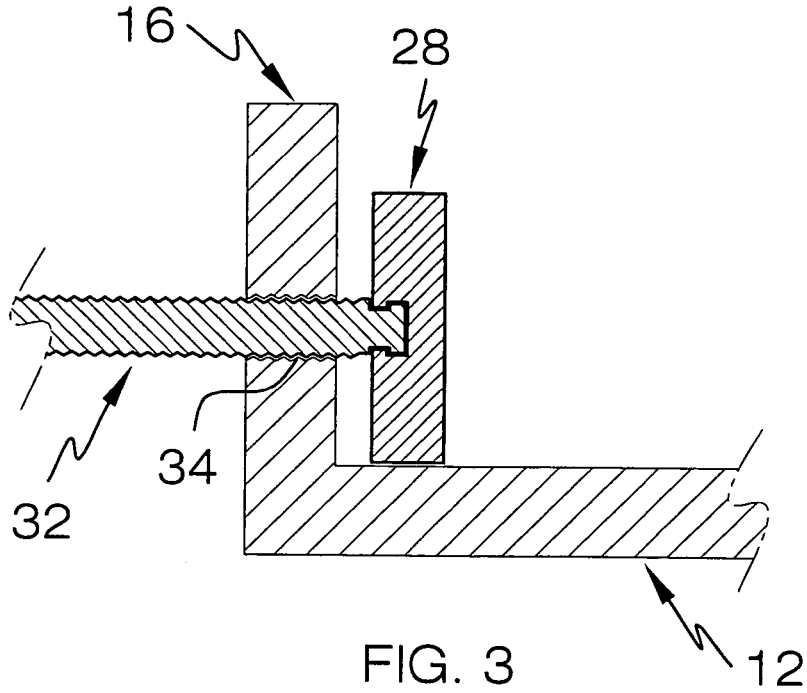
FIG. 3 is a partial, cross-sectional view illustrating the compression plate and the compression means of the present invention blade setting tool.

A detailed view of the compression plate 26 in relation to the second end wall 16 and the compression means 32 is shown in FIG. 3 in a cross-sectional view.

While the preferred embodiment of the invention have been described above, it will be recognized and understood that various modifications can be made in the invention and the appended claims are intended to cover all such modifications which may fall within the spirit and scope of the invention.

What is claimed is:

1. A blade setting tool comprising:

an elongated base plate having two opposing end walls projecting upwardly from a top surface of said elongated base plate;

a calibration blade having a first plurality of teeth fixedly mounted to an inside surface of a first end wall, said first plurality of teeth parallel to said top surface of the elongated base plate;

a compression plate slidably mounted juxtaposed to and spaced apart from an inside surface of a second end wall facing said first end wall;

a compression means for compressing said compression plate toward said first end wall when a reciprocating blade/stationary blade assembly is mounted between said compression plate and said first end wall; and at least two apertures in said elongated base plate for mounting by screws said reciprocating blade to a trimmer after a second plurality of teeth on said reciprocating blade intimately engages and mashes with said first plurality of teeth on said calibration plate.

2. The blade setting tool according to claim 1, wherein said two opposing end walls are integrally formed with the elongated base plate.

3. The blade setting tool according to claim 1, wherein said two end walls are mechanically connected to the elongated base plate.

4. The blade setting tool according to claim 1, wherein said first plurality of teeth on the calibration blade is the same as said second plurality of teeth on the reciprocating blade.

5. The blade setting tool according to the claim 1, wherein said elongated base plate, said two opposing end walls and said compression plates are fabricated of a polymeric material.

6. The blade setting tool according to claim 1, wherein said calibration blade is formed of metal.

7. The blade setting tool according to claim 1, wherein said compression means in a threaded bolt.

8. The blade setting tool according to claim 1, wherein said top surface of said elongated base plate is a plane surface for mating with a plane bottom surface of said stationary blade.

9. The blade setting tool according to claim 1, wherein said first plurality of teeth on said calibration blade is spaced apart from said top surface of the elongated base plate such that a third plurality of teeth on said stationary blade may be inserted under said first plurality of teeth on said calibration blade.

10. The blade setting tool according to claim 1, wherein said tool is capable of calibrating a clearance between a reciprocating blade and a stationary blade between about 0.024 and 0.025 inches.

* * * * *